United States Patent [19]

Dugger et al.

[11] 4,026,131

[45] May 31, 1977

[54] LAUNDRY ADDITIVE DISPENSER

[75] Inventors: Elizabeth L. Dugger, Park Ridge; Alan B. Kessler, Ramsey, both of N.J.

[73] Assignee: Lever Brothers Company, New York, N.Y.

[22] Filed: Aug. 27, 1975

[21] Appl. No.: 608,299

[52] U.S. Cl. ..... 68/17 A; 68/207

[51] Int. Cl.[2] ..... D06F 39/02

[58] Field of Search ..... 222/180, 541, 500; 68/17 A, 207

[56] References Cited

UNITED STATES PATENTS

| | | | |
|---|---|---|---|
| 3,048,993 | 8/1962 | Lucas et al. | 68/17 A |
| 3,575,021 | 4/1971 | Bochan | 68/17 A |
| 3,670,530 | 6/1972 | Filipak | 68/17 A |
| 3,869,069 | 3/1975 | Levey et al. | 222/180 |

*Primary Examiner*—Drayton E. Hoffman
*Assistant Examiner*—Norman L. Stack, Jr.
*Attorney, Agent, or Firm*—Kenneth F. Dusyn; James J. Farrell; Melvin H. Kurtz

[57] ABSTRACT

This application relates generally to the provision of an apparatus for the dispensing of a laundry additive into an automatic washing machine at the proper interval. More specifically, the present application relates to the provision of an apparatus that will introduce a laundry additive into the rinse cycle of an automatic washing machine, which apparatus is disposable upon completion of use.

6 Claims, 5 Drawing Figures

LAUNDRY ADDITIVE DISPENSER

BACKGROUND OF THE INVENTION

There are many laundry additives available commercially that are preferably added to the laundry during the rinse period of an automatic clothes washing machine, whether because of the incompatability of the laundry additive with washing agents generally present in the wash period or cycle, or because of the beneficial efficiency of the laundry additive when introduced into the rinse cycle as opposed to the wash or spin cycle of an automatic washing machine. With the increase in the numbers and types of laundry additives available for use in washing clothes, a need has arisen for an effective device to automatically dispense such laundry additive materials at the proper interval of the cycle of an automatic clothes washing machine. Accordingly, a need has also arisen to provide such an apparatus that will dispense the laundry additive in a clean, effective and simple manner, thereby obviating any of the complicated devices and apparatus that have heretofore been proposed.

One of the types of dispensers for automatically introducing laundry additives into rinse water in automatic washers is a free-bodied dispenser disclosed in U.S. Pat. No. 3,888,391, and in U.S. Pat. No. 2,956,709. The problems associated with these "free-body" type dispensers are that they are messy to fill, i.e., the particular laundry additive has to be manually handled, they are detached from the machine and therefore subject to getting lost, they are cumbersome to use, and subject to clogging; and in some cases they are limited only to the use of a laundry additive in liquid form.

Another type of dispenser is one that is built into the washing machine itself as part of the central agitating post wherein the top of the post is in the form of a cup to which a liquid laundry additive can be added. The centrifugal force obtained by the spin of the agitating post during the rinse cycle or spin cycle causes the liquid additive to emerge whereby the rinse water is enabled to flush out the additive into the laundry. Not only is this type of apparatus cumbersome, but it also causes exposure of the additives to the human hands, and tends to leave a residue in the aforementioned cup due to the lack of efficient flushing of the additive into the laundry. Moreover, this type of apparatus prohibits the use of solid additives which would not flow as evenly as a liquid type additive.

Another type of a built-in dispenser system utilizes a solenoid valve and a gravity feed. Again, it is difficult to dispense solids and any liquid material which has a tendency to gel, since it tends to clog the vlave or the tubing used. More importantly, however, all of the foregoing dispensers require frequent refilling (as often as every wash), which can be untidy and inconvenient, and requires intimate handling of materials which may be irritating to the skin, eyes, mucous membranes, and other parts of the body.

It is therefore an object of the present invention to provide a laundry additive dispensing device that is disposible in nature and which will dispense the laundry additive in a simple and efficient manner during the rinse period of an automatic clothes washing machine.

Another object of the present invention is to provide a laundry additive dispensing apparatus that is responsive to centrifugal force for the dispensation of the laundry additive.

A further object of the invention is to provide an apparatus that has the laundry additive sealed therein, thereby obviating any need for the handling of the additive which may be irritating to the skin, eyes, mucous membranes, or other parts of the body.

An additional object of the invention is to provide an apparatus that will dispense a laundry additive without any limitation as to the physical form the additive takes.

Still another object of the invention is to provide a laundry additive dispensing apparatus that can be easily retrieved and disposed of at the end of the entire laundry washing program.

It has now been discovered that the above and other objects of the present invention are accomplished by the provision of a disposable, single-use apparatus made of inexpensive materials that will effectively add a laundry additive during the spin or rinse period of an automatic washer having an upright central agitating post. Thus, the present invention is applicable for use in only those machines that have a central agitating post for the automatic deterging of washloads.

According to the invention herein, a disposable dispensing apparatus is provided for the dispensing or addition of a laundry additive during the rinse period of an automatic clothes washig machine having an upright central agitating post, comprising a sealed container, adaptable to being positioned onto the agitating post and having disposed therein said laundry additive, and a means for allowing the laundry additive to egress from said container by the centrifugal force exerted on the apparatus occasioned by the continuous rotational movement of the agitating post about its axis. By employing such an apparatus, the consumer can be given the same performance as from laundry additives manually inserted during the rinse period of the automatic washer, and at the same time obtain the convenience of not interrupting the normal operation of the automatic washer, the non-handling of the laundry additive itself, and the ease of disposing the container once it has been used. Moreover, such an apparatus is easy to handle, economical to manufacture at a low cost to the consumer, and safe to use.

For the purposes of expediency, the invention can be best explained and described by referring to a preferred embodiment thereof which is the subject matter of the accompanying drawings. It is to be understood that the scope of the invention is not to be limited thereto.

Referring now to the drawings.

Figure 1:
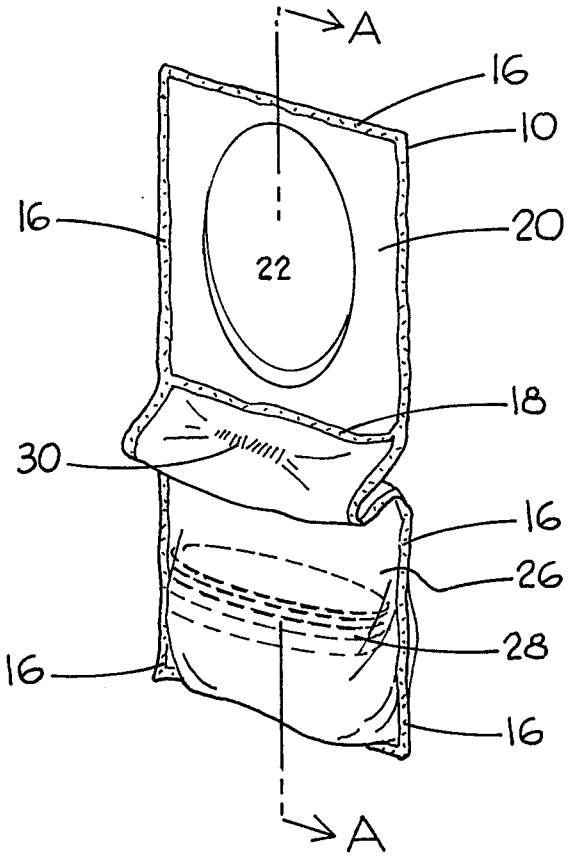
FIG. 1 is a perspective view of a laundry additive dispenser containing a laundry additive, which is a preferred embodiment of the present invention.
Figure 2:
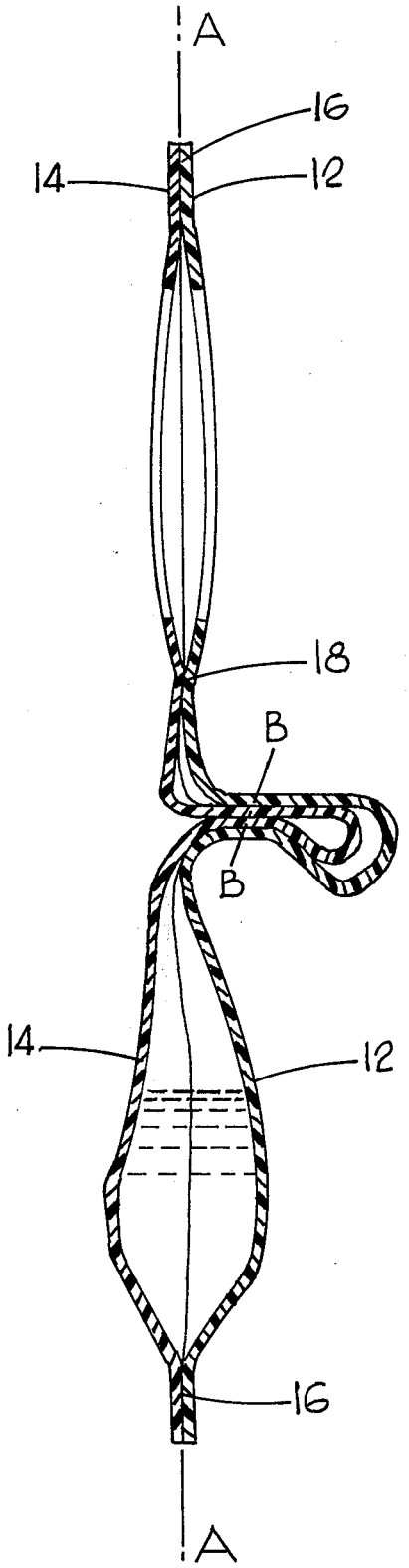
FIG. 2 is a vertical cross-sectional view of the laundry additive dispenser shown in FIG. 1 taken through the section A—A.

Referring now to FIGS. 1 and 2, a preferred embodiment of a laundry additive dispenser 10 is shown having two equal rectangular sheets, 12 and 14, made of flexible laminar polymeric material permanently joined together at their peripheral edges, in this particular instance, by means of a continuous heat seal 16. It is not intended, however, to limit the present embodiment to such flexible laminar polymeric materials, or to the provision of a heat-sealing means. The two laminar sheets are also joined together at their midsection by means of a heat seal 18, to divide the dispenser 10 into two rectangular sections. The top section 20 has a circular opening 22 therethrough large enough to be loosely fitted about the central agitating post 24 of an automatic clothes washing machine (see FIG. 5). The seals 16 and 18, in conjunction with the laminar sheets 12 and 14, also form a lower section 26 which is the sealed container having the laundry additive 28 disposed therein.

Figure 3:
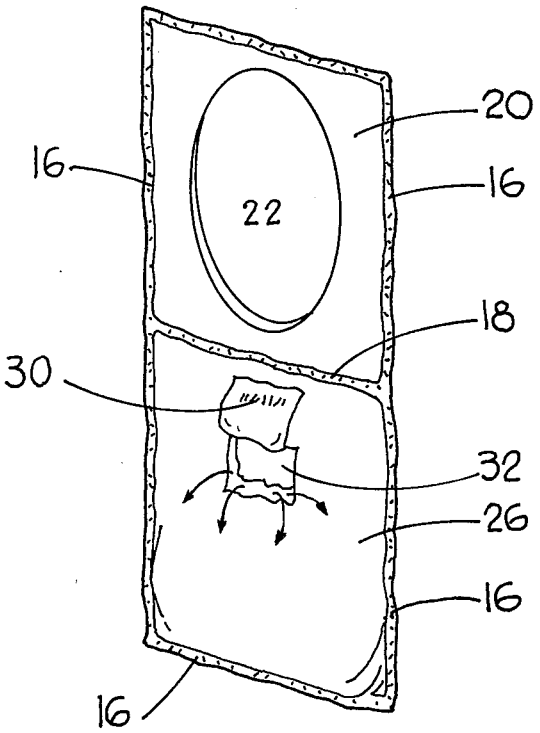
FIG. 3 is a perspective view of the laundry additive dispenser after it has been ruptured by the centrifugal force of a central agitating post in an automatic clothes washing machine.

In order to provide egress of the laundry additive 28 from its container 26 into the automatic clothes washing machine (not shown) during the operation of the rinse period, the two sheets 12 and 14 that form the container portion 26 of the dispenser 10 are folded in the manner shown in FIGS. 1 and 2 and heat-sealed at a short distance from the fold (marked by the line B—B) to provide a permanent seal 30 between the four layers of sheets thus formed. It will be noted that the seal 39 does not extend across the entire width of the fold, although for the purposes of economy or practicality, it can. The object to be kept in mind, in accordance with the invention, is to provide a means to allow the laundry additive to dispense from its container in response to the centrifugal force caused by the rapid continuous rotational movement of the central agitating post about its axis when the dispenser is positioned thereon. Accordingly, the seal 30 must be of a nature to rupture (see FIG. 3) when exposed to the above-identified centrifugal force. This will depend to some extend on the nature of materials used for the container 26.

Before describing the operation of the laundry additive dispenser in accordance with the invention herein, a brief description of the steps involved in operating a standard automatic clothes washing machine having an upright central agitating post will facilitate an understanding and appreciation of the dispenser. The following basic steps are involved.

1. Filling machine with water for wash.
2. Agitating the wash load for two to fifteen minutes by the reciprocating rotational movement of a central finned agitating post (Wash Period).
3. Draining the wash water by gravity and/or pump.
4. Spinning operation to remove most of the residual wash water which involves the continuous rotation of the central agitating post together with the inner clothes tub, thereby creating "centrifugal force" to drive off the water (Spin Period).
5. Filling the automatic washer with water for rinse.
6. Agitating the wash load for 2 to 10 minutes by the movement described in step 2 (Rinse Period).
7. Spinning the central agitating post, together with the inner clothes tub, to remove most of the residual rinse water from the laundry.

Any one of, or combination of, soaks, prewashes and laundry additives can be added to the machine operation. The apparatus according to the invention herein is used to dispense a laundry additive into the machine operation after step 3, that is, after the Wash Period.

Figure 5:
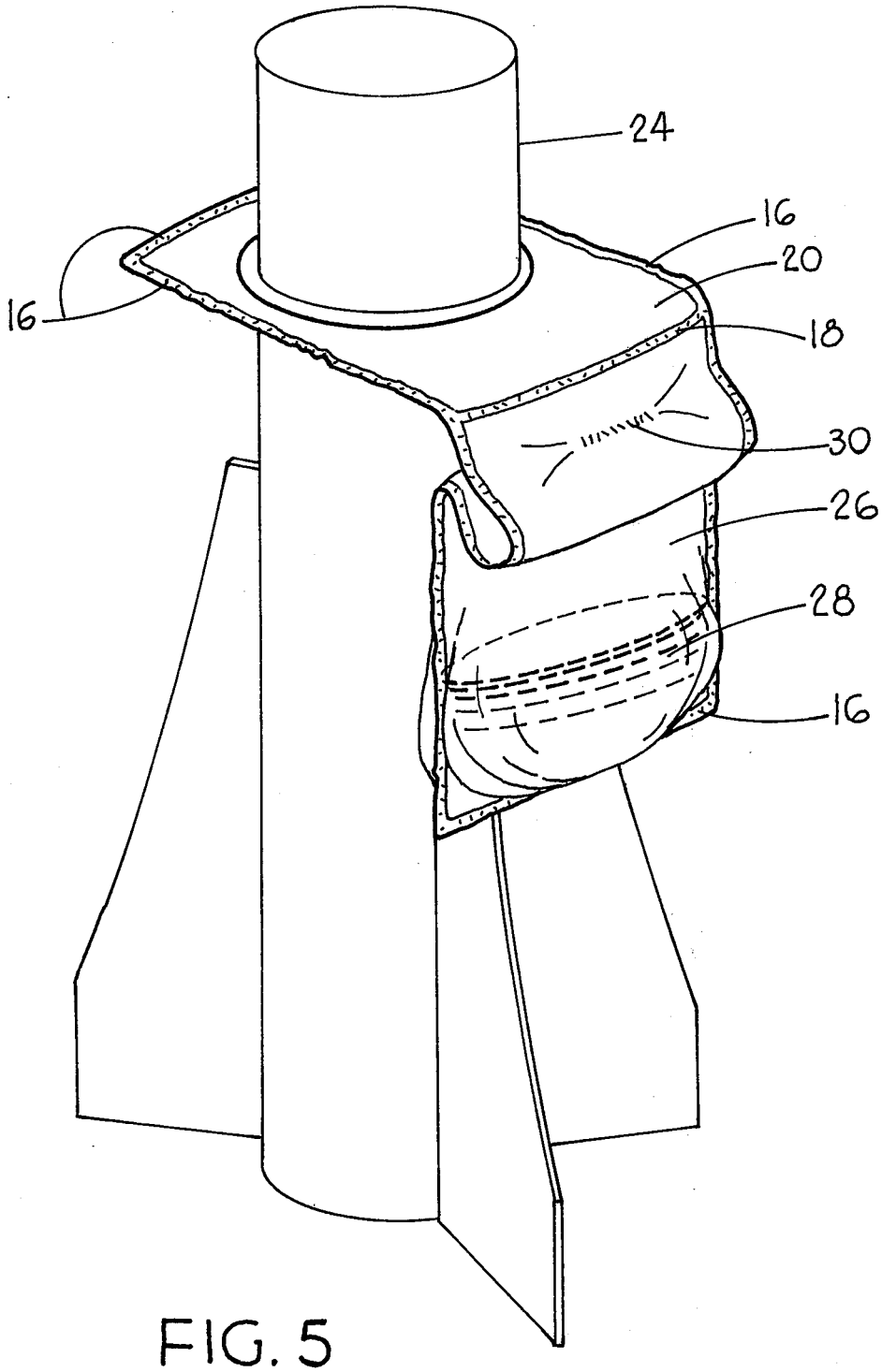
FIG. 5 is a perspective view of the laundry additive dispenser of FIG. 1 positioned about a central agitating post of an automatic clothes washing machine.

Accordingly, the operation of the preferred laundry additive dispenser is simply begun by placing the dispenser onto the central agitating post 24 before the operation of the machine has been initiated, in the manner shown in FIG. 5. Once the machine is started, it will be seen that the sealed dispenser is unaffected by the agitation periods of the automatic washer. However, when the spinning period step is reached (step 4), the dispenser 10 will spin with the central agitating post 24, and the resulting centrifugal force acting on the container 26 and the laundry additive 28 therein, will cause the dispenser 10 to unfold and the seal 30 to become "undone" or ruptured (see FIG. 3). Once the seal 30 is broken or torn, and the spinning of the central agitating post 24 stopped, the automatic washer will fill with the rinse water (step 5) and the laundry additive will exit through the opening 32 as indicated by the directional arrows shown in FIG. 3. As soon as the agitation begins for the second time (step 6), whatever laundry additive remains in the container 26 will be squeezed out by the motion of the container in the rinse water. After the automatic washer has gone through its complete operation, the used dispenser can be lifted off the central agitating post and discarded.

OTHER EMBODIMENTS

In view of what has been described hereinbefore as a preferred embodiment, it will be appreciated that other forms and embodiments are also within the scope of the present invention. Several of the critical features that must be inherent in the type of apparatus previously described and employed to dispense the laundry additive, are that the laundry additive be completely enclosed before the wash cycle is begun, that there be a potential for an opening in the unit to allow egress of the laundry additive, and that this opening be realized by the centrifugal force of the spin of the central agitating post acting upon the unit.

Accordingly, any number of materials other than a flexible laminar polymer substance can be used for the container to enclose the laundry additive, such as, for example, plastic bags, polyethylene-lined paper sheeting or bags, polyethylene-lined foil sheeting or bags, and the like. The material used, however, must be compatible with the nature of the laundry additive which it is to contain, so that the chemical or physical identity of the container itself or the laundry additive is not altered.

With the above in mind, other materials can be used, such as foil sheeting, paper sheeting, plastic boxes, nonwoven or woven cloth sheeting, and cardboard.

Figure 4:
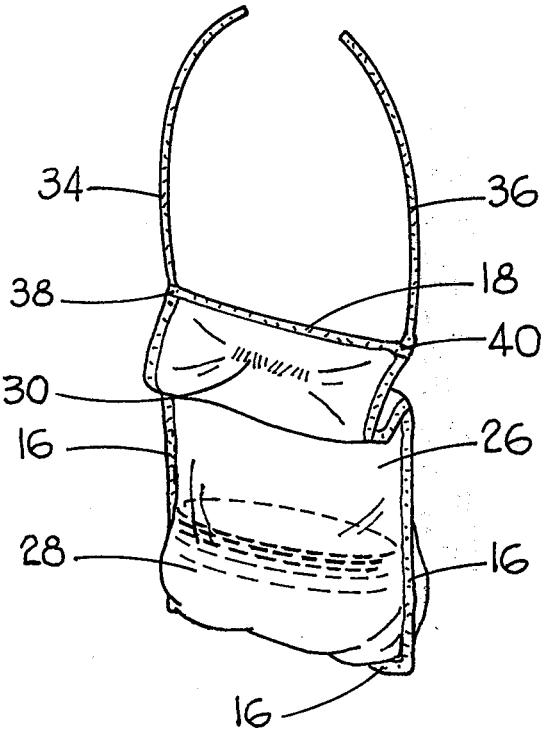
FIG. 4 is a perspective view of a laundry additive dispenser having an alternate means of attachment to the central agitating post of an automatic clothes washing machine.

With regard to the attachment or fixing of the container to the central agitating post 24 of the automatic washer, any number of methods or means that are compatible with the container design and provides for a means to allow exit of the additive from the container through centrifugal force, can be used. By referring to FIG. 4, another preferred embodiment is shown wherein two plastic strips 34 and 36, that may or may not be of the same material as the container, are fixedly attached to the container at the positions identified as 38 and 40, respectively. The strips 34 and 36 are used to tie the container 26 to the central agitating post of the automatic washer. It will be understood that the strips 34 and 36 can also be formed into one continuous strip (not shown) so that the container can be "looped" around the central agitating post. For that matter, any conventional means can be used for placing the dispenser about or attaching it to the central agitating post. For example, wire, string, foil, and water impermeable glue or adhesive are some of the materials that can be used although the scope of the invention herein is not limited to the same.

The type and nature of laundry additives that can be used are any number of commercially available additives on the market. By the term "laundry additive" is meant any substance that is added to the laundry in a standard automatic clothes washing machine, having a central agitating post, after the laundry has been deterged and during the spin or rinse period of the automatic clothes washing machine.

While not being limited to the following types of ingredients, the laundry additive types include the "optical bleaches" (fluorescent dyes), soil release finishes, permanent press finishes, water repellant finishes, sizings, sours, such as laundry rinses used in professional cleaning which may include fluorides and fluorosilicates, and rinsing aids. The rinsing aids are used to remove alkaline residues (for example, carbonates) and can include acetic acid, hydroxy acetic acid, succinic acid, maleic acid, fumaric acid, maleic acid, citric acid, isocitric acid, carboxymethyloxysuccinic acid and carboxymethyloxymalonic acid.

Other equally important types of laundry additive that can be incorporated into the dispenser are "easy ironing" finishes, freshening agents, such as perfumes and deodorants, antibacterial agents, antistatic agents, anti-yellowing agents, anti-pilling agents, fabric strengthening agents, protective agents for fine knitwear, bodying agents, stain removal agents, such as an iron stain removing agent, and water-softening materials.

Of particularimportance are the bleaches, starches, fabric softeners and bluing agents.

In addition to the above, the physical nature of the laundry additive can be in the form of a liquid, gel, powder, granules, flakes, pellets or any other form that is compatible with the chemical nature of the container and which can be ejected from the container by the action of the rinse water and agitation of the centerpost.

What is claimed is:

1. A laundry additive dispensing article for the dispensing of a laundry additive after the spin or during the rinse period of an automatic clothes washing machine having an upright central agitating post comprising:

a. two rectangular plastic sheets joined together and sealed at their perimeter, and at the midsection thereof to form a top and bottom section;

b. said top section having an aperture therethrough to allow said article to be placed about the central agitating post;

c. said bottom section being completely sealed and having the laundry disposed therein;

d. opening means for allowing egress of the laundry additive from said container occasioned by the centrifugal force exerted on the article from the continuous rotational movement of said central agitating post about its axis, said opening means comprising the joinder of said plastic sheets when folded over an area at a point other than the perimeter thereof and at a point above the level of the laundry additive when said article is held in an upright position, such that at least one of the sheets will rupture when subjected to said centrifugal force.

2. A disposable dispensing article for the dispensing of a laundry additive after the spin or during the rinse period of an automatic clothes washing machine having an upright central agitating post, comprising:

a. sealed flexible container having disposed therein said laundry additive;

b. a fastening means joined to said container to position the container about the central agitating post;

c. a container opening means for allowing egress of the laundry additive from said container occasioned by the centrifugal force exerted on the article from the continuous rotational movement of said central agitating post about its axis, said container opening means comprising the joinder of a section of two opposing sides of said container when said sides are folded over an area at a point above the level of the laundry additive when said article is held in an upright position, such that at least one of the joined sides will rupture when subjected to said centrifugal force.

3. The laundry additive dispensing article defined in claim 2 wherein said container is made of at least two sheet of flexible material having the perimeters thereof joined and sealed to each other for the containment of said laundry additive.

4. The laundry additive dispensing article defined in claim 2 wherein said fastening means is a flexible material permanently affixed to said container and capable of being positioned about said agitating post.

5. The laundry additive dispensing article defined in claim 2 wherein said container and fastening means are of the same flexible material, said flexible material being a laminar, polymeric substance.

6. The laundry additive dispensing article defined in claim 4 wherein the container is a flexible metal foil that is chemically compatible with the laundry additive.

* * * * *